US006174273B1

(12) United States Patent
Harding

(10) Patent No.: US 6,174,273 B1
(45) Date of Patent: Jan. 16, 2001

(54) CUSHIONING CONVERSION MACHINE WITH TENSION CONTROL

(75) Inventor: Joseph J. Harding, Mentor, OH (US)

(73) Assignee: Ranpak Corp., Concord Township, OH (US)

( * ) Notice: Under 35 U.S.C. 154(b), the term of this patent shall be extended for 0 days.

(21) Appl. No.: 09/217,245

(22) Filed: Dec. 18, 1998

(51) Int. Cl.[7] ..... B31B 1/00

(52) U.S. Cl. ..... 493/24; 493/29; 493/967; 493/340

(58) Field of Search ..... 493/340, 464, 493/957, 29, 24, 8, 967; 226/42, 44, 45

(56) References Cited

U.S. PATENT DOCUMENTS

| | | |
|---|---|---|
| 2,569,589 | 10/1951 | Trissell . |
| 2,721,709 | 10/1955 | Auerbacher . |
| 2,860,703 | 11/1958 | O'Donnell . |
| 2,882,802 | 4/1959 | Walker . |
| 3,069,107 | 12/1962 | Hirt . |
| 3,136,462 | 6/1964 | Knutson . |
| 3,238,852 | 3/1966 | Schur et al. . |
| 3,283,874 | 11/1966 | Goreham . |
| 3,509,797 | 5/1970 | Johnson . |
| 3,603,216 | 9/1971 | Johnson . |
| 3,655,500 | 4/1972 | Johnson . |
| 3,682,696 | 8/1972 | Yasuda . |
| 3,799,039 | 3/1974 | Johnson . |
| 3,880,372 | 4/1975 | Witte . |
| 3,899,166 | 8/1975 | Behn . |
| 4,026,198 | 5/1977 | Ottaviano . |
| 4,059,256 | 11/1977 | Palmer . |
| 4,085,662 | 4/1978 | Ottaviano . |
| 4,109,040 | 8/1978 | Ottaviano . |
| 4,237,776 | 12/1980 | Ottaviano . |
| 4,258,846 | 3/1981 | Campo . |
| 4,557,716 | 12/1985 | Ottaviano . |
| 4,650,456 | 3/1987 | Armington . |
| 4,657,164 | 4/1987 | Felix . |
| 4,717,613 | 1/1988 | Ottaviano . |
| 4,750,896 | 6/1988 | Komaransky et al. . |
| 4,839,210 | 6/1989 | Komaransky et al. . |
| 4,884,999 | 12/1989 | Baldacci . |
| 4,937,131 | 6/1990 | Baldacci et al. . |
| 4,968,291 | 11/1990 | Baldacci et al. . |
| 5,123,889 | 6/1992 | Armington et al. . |
| 5,186,409 | 2/1993 | Kansaku . |
| 5,188,581 | 2/1993 | Baldacci . |
| 5,211,620 | 5/1993 | Ratzel et al. . |
| 5,322,477 | 6/1994 | Armington et al. . |
| 5,387,173 | 2/1995 | Simmons . |
| 5,546,993 * | 8/1996 | Summey et al. ..... 139/311 |
| 5,674,172 | 10/1997 | Armington et al. . |

(List continued on next page.)

FOREIGN PATENT DOCUMENTS

| | | |
|---|---|---|
| 0 523 382 | 1/1993 | (EP) . |
| 95 31296 | 11/1995 | (WO) . |
| 96 15968 | 5/1996 | (WO) . |
| 96 24540 | 8/1996 | (WO) . |
| 96 40496 | 12/1996 | (WO) . |

*Primary Examiner*—Stephen F. Gerrity
*Assistant Examiner*—Sam Tawfik
(74) *Attorney, Agent, or Firm*—Renner, Otto, Boisselle & Sklar LLP

(57) ABSTRACT

A cushioning conversion machine and method for converting sheet stock material into a cushioning dunnage product and wherein the tension in the stock material is controlled to avoid problems associated with improper tension. A conversion assembly draws the stock material from a stock supply and converts the stock material into a strip of cushioning, and a controller controls the operation of the conversion assembly. The conversion assembly is powered by a motor and the controller controls the operation of the motor in response to a sensed parameter related to the tension in the paper. In another embodiment, a torque control is interposed between the feed motor and feed components that engage the stock material.

13 Claims, 3 Drawing Sheets

U.S. PATENT DOCUMENTS 5,735,784 * 4/1998 Ratzel ..... 493/29
5,813,967 9/1998 Davila .
5,871,429 * 2/1999 Harding et al. ..... 493/25
5,897,478 * 4/1999 Harding et al. ..... 493/22

* cited by examiner

CUSHIONING CONVERSION MACHINE WITH TENSION CONTROL

FIELD OF THE INVENTION

The invention herein described relates generally to cushioning conversion machines and more particularly to improvements in controlling the tension of the stock material fed into such machines for conversion into a dunnage product.

BACKGROUND OF THE INVENTION

In the process of shipping an item from one location to another, protective packaging material is often placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and plastic foam peanuts is their affect on our environment. Quite simply, these plastic packaging materials are not biodegradable, and therefore they cannot avoid further multiplying our planet's already critical waste disposal problems. The non-biodegradability of these packaging materials has become increasingly important in light of many industries adopting more progressive policies in terms of environmental responsibility.

The foregoing and other disadvantages of conventional plastic packaging materials have made paper protective packaging material a popular alternative. Paper is biodegradable, recyclable and composed of a renewable resource, making it an environmentally responsible choice for conscientious shippers.

While paper in sheet form could possibly be used as a protective packaging material, it is usually preferable to convert the sheets of paper into a relatively low density pad-like cushioning or dunnage product. This conversion may be accomplished by a cushioning conversion machine, such as that disclosed in commonly assigned U.S. Pat. No. 5,123,889. The conversion machine disclosed in U. S. Pat. No. 5,123,889 converts sheet stock material, such as paper in multi-ply form, into relatively low density pads. Specifically, the machine converts this stock material into a continuous unconnected strip having lateral pillow portions separated by a thin central band. This strip is connected as by coining along its central band to form a coined strip which is cut into sections, or pads, of a desired length. The stock material preferably consists of three superimposed webs or layers of biodegradable, recyclable and reusable thirty-pound Kraft paper rolled onto a hollow cylindrical tube. A thirty-inch wide roll of this paper, which is approximately 450 feet long, weighs about 35 pounds and will provide cushioning equal to approximately sixty cubic feet of plastic foam peanuts while at the same time requiring less than one-thirtieth the storage space.

The conversion machines known in the prior art, including the one shown in U.S. Pat. No. 5,123,889, have used a freely rotating roll from which the stock material to be converted is fed by means of the same mechanism that advances the material through the forming portion of the machine. Specifically a pair of gears that have performed a connecting operation have been used to advance the material being converted. These gears stop and start their rotation during the conversion process, and this results in the need to accelerate the stock roll every time the gears start, with resulting changes in the tension of material being fed through the conversion machine. These changes in the tension of the material can affect the quality of the dunnage product being produced.

Also, when the conversion process is stopped, the rotational inertia of the stock roll can cause the stock roll to overrun and form a loose loop of material at the supply end of the conversion machine. When the conversion process is resumed, initially the material will be at a relatively low tension until the loose loop of material is taken up, at which point the tension on the paper will rapidly increase, almost instantaneously, to a relatively high level until the stock roll accelerates to match the feed rate through the machine. This quick change in tension can cause the material to tear, as well as degrade the quality of the dunnage product being produced.

SUMMARY OF THE INVENTION

The present invention provides a cushioning conversion machine and method for converting sheet stock material into a cushioning dunnage product and wherein the tension in the stock material is controlled to avoid one or more of the paper tension problems associated with prior art conversion machines and methods.

According to one aspect of the invention, a cushioning conversion machine and method for converting sheet stock material into a cushioning dunnage product are characterized by a stock supply assembly which supplies stock material to be converted, a conversion assembly which draws the stock material from the stock supply and converts the stock material into a strip of cushioning, and a controller which controls the operation of the conversion assembly. The conversion assembly is powered by a motor and the controller controls the operation of the motor in response to a sensed parameter related to the tension in the paper.

In one embodiment, a tension sensor is provided to sense the tension in the stock material as it is drawn from the stock supply by the conversion assembly and to provide to the controller an output signal indicative of the sensed tension. In response to the tension sensed by the tension sensor, the controller adjusts the speed of the motor thereby to adjust the rate at which the stock material is drawn from the stock supply to maintain a prescribed and preferably substantially constant tension in the stock material. In a preferred embodiment, the stock supply assembly includes a resiliently biased member over which the stock material is trained such that movement of the resiliently biased member is related to the tension in the stock material; and the tension sensor includes a sensing device which senses movement of the resiliently biased member against a biasing force and outputs a signal related to such movement of the resiliently biased member. A preferred resiliently biased member is an idler roller journalled in mounts at opposite ends of the idler roller, and a preferred sensing device includes load cells at the roller mounts. The output signals of the load cells at the roller mounts preferably are averaged to provide an averaged value of the measured tension in the stock material.

In another embodiment, motor torque is sensed and fed back to the controller as a measure of the tension in the stock material. In the case of an electric feed motor, motor current is sensed and fed back to the controller for maintaining the motor current in accordance with a prescribed criteria, such as below a predetermined maximum current.

According to another aspect of the invention, a cushioning conversion machine and method for converting sheet stock material into a cushioning dunnage product are characterized by a stock supply assembly which supplies stock material to be converted, and a conversion assembly which draws the stock material from the stock supply and converts the stock material into a strip of cushioning. The conversion assembly includes a feed mechanism which engages the stock material and feeds it through the conversion assembly. The feed mechanism is connected to a motor by a clutch device which limits the applied torque or force to the feed mechanism to a prescribed maximum value. In a preferred embodiment, a slip clutch is used to limit the torque applied by a motor to the feed mechanism which may include cooperating rotating feed wheels which not only feed the stock material but also function to connect together overlapped portions of the stock material.

Further in accordance with the invention, there is provided a method of converting sheet stock material into a cushioning dunnage product which includes drawing the stock material from a stock supply and converting the stock material into a strip of cushioning, while controlling the rate at which the stock material is drawn in response to the tension in the stock material.

The foregoing and other features of the invention are hereinafter fully described and particularly pointed out in the claims, the following description and the annexed drawings setting forth in detail one or more illustrative embodiments of the invention, such being indicative, however, of but one or a few of the various ways in which the principles of the invention may be employed.

DETAILED DESCRIPTION

Figure 1:
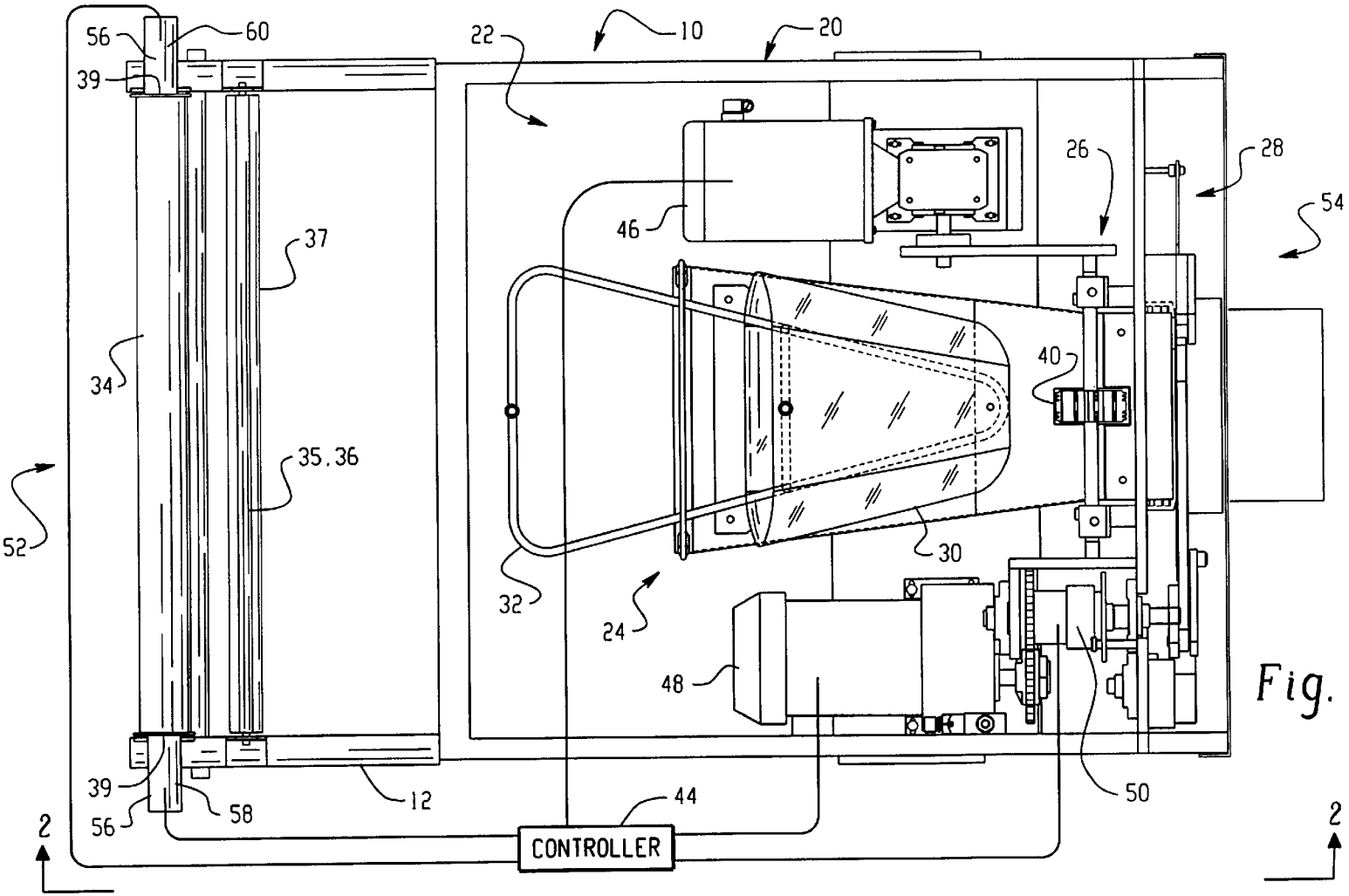
FIG. 1 is a top plan view of a dunnage conversion machine constructed in accordance with the present invention, with a top cover and panel thereof removed to permit viewing of internal components of the machine.
Figure 2:
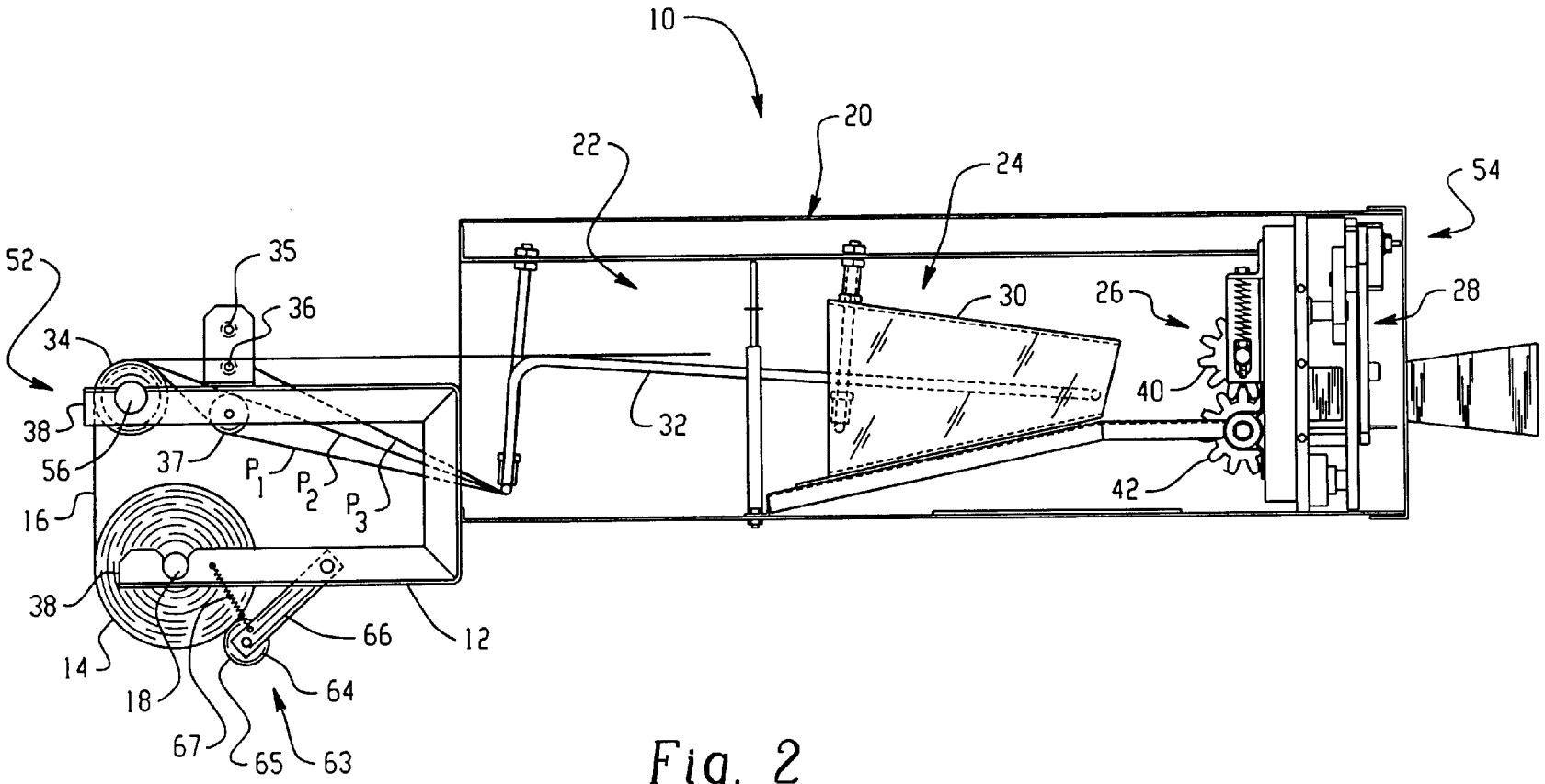
FIG. 2 is a side elevational view of the machine shown in FIG. 1, with a side panel thereof removed to permit viewing of internal components of the machine.

Referring now to the drawings in detail and initially to FIGS. 1 and 2, a preferred embodiment of a cushioning conversion machine 10 according to the present invention is shown. The conversion machine 10 has a stock supply which, in the illustrated embodiment, includes an integral stock roll holder assembly 12 for supporting a roll 14 of sheet stock material 16. Alternatively, the sheet material 16 may be supplied from a separate stand holding the sheet material, or by other suitable means.

The stock material 16 preferably consists of one or more, typically two or three, superimposed webs, or plies $P_1$, $P_2$ and $P_3$ of biodegradable, recyclable and reusable sheet material, such as Kraft paper rolled onto a hollow cylindrical tube 18. The machine 10 converts this stock material 16 into a crumpled strip of cushioning/dunnage (not shown). The machine 10 also has provision for severing, as by cutting, the strip to form a discrete pad of desired length, as is further discussed below.

The machine 10 generally comprises a housing 20 and a conversion assembly 22 that may include several sub-assemblies which form the pads. These sub-assemblies in the illustrated conversion machine include a forming assembly 24, a feed/connecting assembly 26, and/or a severing assembly 28, all of which are mounted in or to the housing 20. The illustrated forming assembly 24 includes a shaping chute 30 and a forming member 32 for forming the sheet material 16 into a relatively thicker three-dimensional strip that is then connected by the feed/connecting assembly 26 to form the cushioning strip that is cut to length by the severing assembly 28.

During operation of the machine 10, the stock material 16 is payed off of the stock roll 14 and travels over a constant entry roller 34. After passage over the constant entry roller 34, the plies $P_1$, $P_2$ and $P_3$ are separated for passage between or around separators 35–37. The constant entry roller 34 and separators 35–37 are mounted between brackets 38 attached to the rear end of the housing 20. For further details of the constant entry roller and separators, reference may be had to U.S. Pat. No. 5,123,889. In the illustrated embodiment, the brackets 38 are U-shaped with the base thereof attached to the machine housing 20, the upper legs thereof supporting the constant entry roller 34 and separators 35, 36, 37 and the lower legs thereof supporting the stock roll 14.

From the separators 35–37, the separated plies $P_1$, $P_2$ and $P_3$ pass to the forming assembly 24. The forming assembly 24 causes inward folding of the lateral edges of the sheet stock material 16 to form a continuous strip having lateral pillow portions and a thinner central band portion. The feed/connecting assembly 26, which in the illustrated embodiment includes a pair of cooperating gear-like members 40 and 42, pulls the stock material 16 downstream through the machine 10 and also connects the layers along the central band, as by coining and/or perforating in the illustrated preferred embodiment, to form a connected strip. As the connected cushioning strip travels downstream from the feed assembly 26, the severing assembly 28 cuts the strip into pads of a desired length. For further details of the illustrated embodiment and similar cushion-producing machines, reference may be had to U.S. Pat. No. 5,123,889 and published PCT Application No. US96/09109.

The production of dunnage pads by the illustrated machine 10 is controlled by a controller (diagrammatically shown at 44) usually provided in the housing 20 or in a remote unit. For details of the general operation of the controller 44, reference may be had to commonly assigned U.S. Pat. Nos. 4,619,635 and 5,571,067 and to published PCT Application No. PCT/US95/09275, which are hereby incorporated herein by reference in their entireties. In pertinent part, the controller 44 controls operation of a feed motor 46 which drives the feed components and particularly the rotating gear-like members 40 and 42. The controller 44 also controls operation of a cutter motor 48 and a clutch 50 which drives the severing assembly 28. Preferably, the cutter motor 48 is continuously operated whereas control of the clutch 50 controls the operation of the severing assembly 28. The functions of the controller 44 may be carried out by a single processor device or by separate devices suitably interfaced to coordinate the operation of the feed motor 46, cutter motor 48 and clutch 50.

An exemplary pad produced by the illustrated machine 10 comprises the one or more plies of sheet material 16 that have side portions thereof folded over the center portions thereof to form laterally spaced-apart pillow portions extending along the length of the pad. The pillow portions are separated by a central band where lateral edge portions are brought together. The lateral edge portions, which may be overlapped and/or interleaved, are connected together, and/or to underlying center portions of the plies along the central band. In a preferred form of cushioning pad, the connecting is accomplished by a combination of coining and stitching, the stitching being effected by perforations and/or cut tabs disposed along the central band. However, it will be appreciated by those skilled in the art that other types of conversion machines may be used to produce the same or other forms of cushioning strips. For further details of an exemplary pad, reference may be had to published PCT Application No. US96/09109, which is hereby incorporated herein by reference in its entirety.

The housing 20 of the conversion machine 10 has a longitudinal axis corresponding to the direction of passage of the sheet material 16 downstream through the conversion assemblies from a rear or upstream end 52 to a front or downstream end 54 of the machine 10. The housing 20 is generally rectangular in cross-section taken transverse to the longitudinal axis of the machine 10. The machine 10 may be supported in any suitable manner, for example by a stand.

The machine 10 as thus far described is similar to the machine described in greater detail in U.S. Pat. No. 5,123,889 (hereby incorporated herein by reference) and reference may be had thereto for further details of the general arrangement and operation of the machine. However, it is noted that the illustrated forming assembly 24 is of the type described in pending U.S. Patent application Ser. No. 08/386,355 and similar to that shown in U.S. Pat. Nos. 5,123,889 and 5,674,172 all of which are hereby incorporated herein by reference. While the forming assembly 24 is preferably like that shown in U.S. Pat. No. 5,674,172, other forming assemblies are also usable in the practice of the present invention.

As depicted in FIG. 1, the conversion machine 10 also includes a web tension sensor 56 for measuring the tension in the stock material 16 as it is drawn through the forming assembly 24 and provides an output to the controller 44 which, in response to the sensed tension, adjusts the speed of the feed motor 46 to prevent the tension from increasing to a point that would cause tearing or otherwise negatively impact the strip of cushioning material being produced. The tension sensor 56 may be any suitable device for sensing the tension in the web of stock material 16. For example, as shown in the illustrated embodiment, the tension sensor 56 may include a pair of load cells 58 and 60 integrated into the mounts 39 supporting the ends of the constant entry roller 34 (or other roller over which the stock material 16 is trained such that the tension on the stock material 16 exerts a force on the supports for the roller). The value of the measured tension is communicated as an electrical signal to the controller 44.

As a further example of a tension sensing arrangement, the constant entry roller 34 (or other roller) may be supported at its ends 39 by spring biased plungers (not shown). The plungers will be depressed in relation to the tension in the stock material 16 and the extent of such depression may be determined by a sensor (such as a LVDT) or sensor array, or other suitable means, which provides a signal to the controller 44 that is representative of the tension in the stock material 16.

In the illustrated preferred embodiment, the controller 44 compares the measured tension with an upper limit and optionally a lower limit. In the event the tension in the stock material 16 exceeds the upper limit, the controller 44 will reduce the motor speed from its normal operating speed until the sensed tension falls below the lower limit, at which point the controller 44 will increase the speed of the motor 46 to its normal operating value. Also, if desired, the motor speed can be increased by the controller 44 in the event the sensed tension falls below the lower limit. Provision may also be made to shut off the feed motor 46 if the tension abruptly changes, for example, drops suddenly to zero or a very low value as might arise from a tear in the stock material 16 or when the paper runs out. By controlling the maximum tension applied to the stock material 16, tearing of the stock material can be substantially reduced or eliminated. Also, such tension control provides for production of a better pad.

This tension sensing arrangement is particularly useful during initial feeding of the stock material 16. During such start-up of the stock material feeding, the tension in the sheet stock material 16 may rise rapidly in attempting to overcome the inertia of the stationary stock roll 14. This can place the sheet material 16 under considerable tension and cause tearing, production of an undesirable pad, and/or jam the feeding/connecting assembly 26. To prevent or reduce the likelihood of such undesirable effects, the speed of the feed motor 46 can be controllably "ramped up" during start-up. Also, the tension sensor 56 enables the controller 44 to monitor the tension in the stock material 16 and make any needed speed adjustments to keep the tension in the stock material 16 below the prescribed maximum tension. As will be appreciated, the speed and/or torque of the feed motor 46 can be gradually increased, or ramped up, while maintaining a constant tension on the paper web until the motor 46 attains a desirable steady state speed and, consequently, the conversion machine 10 attains a steady state feeding condition. Because the tension is controllably attained within a constant tension range (without an abrupt tension spike), there is little chance that the gears 40, 42 will tear the stock material 16 or that the stock material 16 will tear at its edges while being drawn by the feeding/connecting assembly 26. As will further be appreciated, the tension set points may be adjusted, as desired, for stock materials having different weights, strengths, plies, etc.

The controller 44 may also be programmed to "ramp down" or gradually decelerate the feed motor 46 to avoid overrunning of the stock roll 14 and formation of a loose loop of stock material 16 at the supply end of the conversion machine 10. In the absence of such a "ramp down," when the conversion process is resumed, and the loose loop of material 16 is taken up, the tension on the stock material 16 rapidly increases and can cause undesirable effects such as those described above. Before a strip of cushioning material 16 is to be cut and before the feed motor 46 is stopped, the controller 44 progressively decreases the speed of the motor 46. The tension in the stock material 16 may be sensed by the tension sensor 56 to inform the controller 44 that the stock roll 14 may be starting to overrun, in which case the controller 44 can reduce the deceleration rate. This ensures relatively constant tension in the web of stock material 16. If needed, a brake 63 (shown in FIG. 2 only) may be employed to place a drag on the stock roll 14 to assist in reducing overrunning of the stock roll 14 and maintaining substantially constant tension in the stock material 16. The brake 63 may comprise, for example, a friction roller assembly 64 to provide constant resistance to rotation of the stock roll 14. As shown in FIG. 2, the friction roller assembly 64 includes a roller 65 mounted to a swing arm 66 which is pivotally secured to the mounting brackets 38. Spring 67 pulls the roller 62 against the surface of the stock roll 14 to provide a continuous and preferably constant drag. Any suitable means for generating a frictional load on the stock roll may be used, such as a drum-type brake, a caliper-type brake, or even a set screw which bears down on a turning shaft. In the illustrated arrangement, the braking force will progressively decrease as the diameter of the stock roll 14, and thus its inertial mass, decreases.

Figure 3:
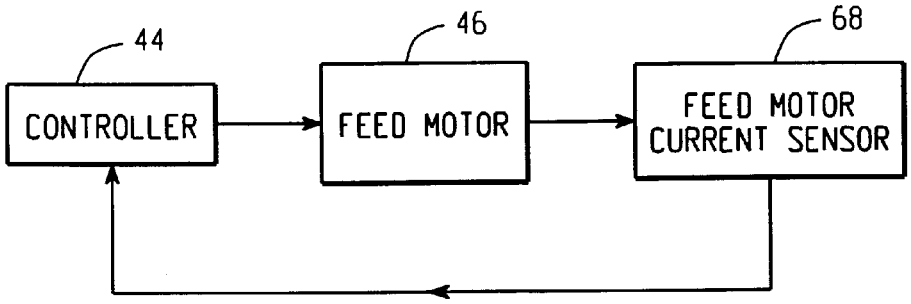
FIG. 3 is a diagrammatical illustration of another embodiment of the invention.

FIG. 3 shows another arrangement for controlling the tension in the stock material 16 whereby the motor torque or current is monitored instead of directly sensing the tension in the stock material 16. In the FIG. 3 arrangement, a current sensor 68, for example, an ammeter, is electrically coupled to the feed motor 46 and measures the current drawn by the feed motor 46. The current increases when the feed motor 46 experiences a demand for more power, for example, when the tension in the web 16 increases such as when the drag (i.e. inertia) of the stock roll 14 requires additional power to be overcome. Similarly, the current drawn by the feed motor 46 decreases when the motor 46 experiences a relatively lower or no demand for power, for example, when the tension in the web 16 decreases such as when the rotational kinetic energy of the stock roll 14 urges the stock material 16 forward at a rate faster than can be drawn by the feed motor 46. The current sensor 68 senses, or measures, the current corresponding to the amount of tension in the stock material 16 and communicates this information to the controller 44. The controller 44, in turn, compares the sensed current with an upper limit and optionally a lower limit. The controller 44, as similarly described above with reference to the embodiment shown in FIG. 1, reduces or increases the feed motor speed in response to the measured tension, respectively, exceeding the upper limit or falling below the lower limit. The controller 44 and current sensor 68 provide the advantages of controlling the speed and/or torque of the feed motor 46 during start-up, thereby lessening the chances of rapid increases in tension, or during ramp down, thereby lessening the chances of overrun by the stock roll 14.

Figure 4:
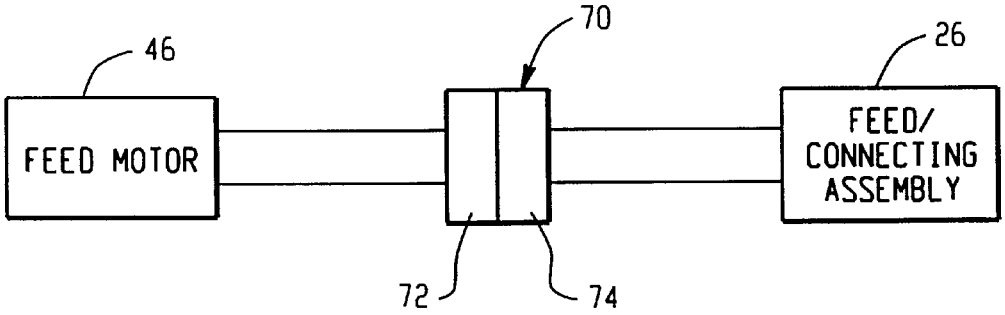
FIG. 4 is a diagrammatical illustration of still another embodiment of the invention.

FIG. 4 shows yet another arrangement for controlling the tension in the stock material 16 whereby the applied torque is limited by a clutch device 70. In the FIG. 4 arrangement, the clutch device 70 limits the torque transferred from the feed motor 46 to the feed/connecting assembly 26 to a prescribed maximum value to prevent the tension in the stock material 16 from increasing to a point that would cause tearing or otherwise negatively impact the strip of cushioning material 16. The clutch device 70 may be any suitable device, for example, the clutch device 70 may include a slip clutch having first and second clutch plates 72 and 74 that frictionally engage one another when the torque experienced by the feed motor 46 is below the prescribed limit and disengage, or slip, when the torque exceeds the prescribed limit.

Although the invention has been shown and described with respect to certain preferred embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A conversion machine for converting sheet stock material into a cushioning dunnage product, comprising a stock supply assembly which supplies stock material to be converted, a conversion assembly which draws the stock material from the stock supply and converts the stock material into a strip of cushioning, and a controller which controls the conversion assembly, wherein the conversion assembly is powered by a motor and the controller controls the motor in response to a sensed parameter related to tension in the stock material;

wherein a tension sensor is provided to sense the tension in the stock material as it is drawn from the stock supply by the conversion assembly and to provide to the controller an output signal indicative of the sensed tension, and in response to the tension sensed by the tension sensor, the controller adjusts a speed of the motor thereby to adjust a rate at which the stock material is drawn from the stock supply to control the tension in the stock material;

wherein the stock supply assembly includes a resiliently biased member over which the stock material is trained such that movement of the resiliently biased member is related to tension in the stock material, and the tension sensor includes a sensing device which senses movement of the resiliently biased member against a biasing force and outputs a signal related to such movement of the resiliently biased member; and wherein the resiliently biased member is an idler roller journalled in mounts at opposite ends of the idler roller, and the sensing device includes a load cell at at least one of the roller mounts.

2. A conversion machine as set forth in claim 1, including a load cell at each roller mount, and wherein the output signals of the load cells at the roller mounts are averaged to provide an averaged value of the measured tension in the stock material.

3. A conversion machine for converting sheet stock material into a cushioning dunnage product, comprising a stock supply assembly which supplies stock material to be converted, a conversion assembly which draws the stock material from the stock supply and converts the stock material into a strip of cushioning, and a controller which controls the conversion assembly, wherein the conversion assembly is powered by a motor and the controller controls the motor in response to a sensed parameter related to tension in the stock material; and wherein the sensed parameter is motor current and the sensed motor current is fed back to the controller for maintaining the motor current in accordance with a prescribed criteria.

4. A cushioning conversion machine for converting sheet stock material into a cushioning dunnage product, comprising a stock supply assembly which supplies stock material to be converted, and a conversion assembly which draws the stock material from the stock supply and converts the stock material into a strip of cushioning, wherein the conversion assembly includes a feed mechanism which engages the stock material and feeds it through the conversion assembly, and the feed mechanism is connected to a motor by a torque limiting device which limits torque applied to the feed mechanism by the motor to a prescribed maximum value.

5. A conversion machine as set forth in claim 4, wherein the torque limiting device includes a slip clutch to limit torque applied by a motor to the feed mechanism.

6. A conversion machine as set forth in claim 5, wherein the feed mechanism includes cooperating rotating feed wheels which feed the stock material and also function to connect together overlapped portions of the stock material.

7. A method of converting sheet stock material into a cushioning dunnage product, comprising drawing the stock material from a stock supply and converting the stock material into a strip of cushioning, while controlling a rate at which the stock material is drawn in response to tension in the stock material;

wherein the stock material is converted by a conversion assembly that is powered by a motor and a controller controls the motor;

wherein a tension sensor senses tension in the stock material as it is drawn from the stock supply by the conversion assembly and provides to the controller an output signal indicative of the sensed tension, and in response to the tension sensed by the tension sensor, the controller adjusts a speed of the motor thereby to adjust a rate at which the stock material is drawn from the stock supply to control tension in the stock material in accordance with a prescribed criteria; and wherein the stock supply assembly includes a resiliently biased member over which the stock material is trained such that movement of the resiliently biased member is related to tension in the stock material, and the tension sensor includes a sensing device which senses movement of the resiliently biased member and outputs a signal related to such movement of the resilienty biased member.

8. A conversion method as in claim 7, wherein the resiliently biased member is an idler roller journalled in mounts at opposite ends of the idler roller, and the sensing device includes a load cell at at least one of the roller mounts.

9. A method of converting sheet stock material into a cushioning dunnage product, comprising drawing the stock material from a stock supply and converting the stock material into a strip of cushioning, while controlling a rate at which the stock material is drawn in response to tension in the stock material; and wherein an electric feed motor is provided to power the conversion assembly, and the motor current is sensed as a measure of the tension in the stock material and is fed back to the controller for maintaining the motor current in accordance with a prescribed criteria.

10. A conversion method for converting sheet stock material into a cushioning dunnage product, comprising drawing sheet stock material from a stock supply and converting the stock material into a strip of cushioning, such drawing being effected by a feed mechanism which engages the stock material and feeds it through a conversion assembly, and wherein a torque limiting device is used between the feed mechanism and a motor to limit torque applied to the feed mechanism by the motor to a prescribed maximum value.

11. A conversion method as set forth in claim 10, wherein the torque limiting device includes a slip clutch to limit torque applied by the motor to the feed mechanism.

12. A conversion method as set forth in claim 11, wherein cooperating rotating feed wheels are used in the feed mechanism to feed the stock material and also to connect together overlapped portoins of the stock material.

13. A conversion method as set forth in claim 10, wherein the sheet stock material comprises a multi-ply Kraft material.

* * * * *